US009895576B1

(12) United States Patent
Orgal

(10) Patent No.: US 9,895,576 B1
(45) Date of Patent: Feb. 20, 2018

(54) PHYSIOTHERAPEUTIC STAIR AND INCLINE SYSTEM

(71) Applicant: DPE MEDICAL LTD., Shoeva (IL)

(72) Inventor: Daniel Orgal, Shoeva (IL)

(73) Assignee: DPE MEDICAL LTD., Shoeva (IL)

( * ) Notice: Subject to any disclaimer, the term of this patent is extended or adjusted under 35 U.S.C. 154(b) by 0 days.

(21) Appl. No.: 15/350,055

(22) Filed: Nov. 13, 2016

(51) Int. Cl.
*A63B 22/00* (2006.01)
*A63B 23/04* (2006.01)
*A63B 24/00* (2006.01)

(52) U.S. Cl.
CPC ..... *A63B 23/0458* (2013.01); *A63B 24/0062* (2013.01); *A63B 24/0087* (2013.01); *A63B 2213/00* (2013.01); *A63B 2220/62* (2013.01); *A63B 2220/833* (2013.01); *A63B 2225/09* (2013.01); *A63B 2225/093* (2013.01)

(58) Field of Classification Search
None
See application file for complete search history.

(56) References Cited

U.S. PATENT DOCUMENTS 3,497,215 A * 2/1970 Harrison ..... A63B 21/154 482/53
5,769,759 A * 6/1998 Alter ..... A63B 22/04 482/37
5,901,813 A * 5/1999 Orgal ..... B66B 9/08 187/200
6,238,320 B1 * 5/2001 Flanagan ..... A63B 3/00 482/130
6,601,677 B1 * 8/2003 Storm ..... B66B 9/0869 187/200
6,609,478 B2 * 8/2003 Del Valle ..... A01K 15/027 119/703
7,383,600 B2 * 6/2008 Carrigan ..... E01D 15/24 14/69.5
7,927,257 B2 * 4/2011 Patel ..... A63B 21/00181 482/142
8,807,283 B2 * 8/2014 Shell ..... B66B 9/0869 182/1
9,091,083 B1 * 7/2015 Goudreau ..... E04F 11/066
9,381,397 B2 * 7/2016 Orgal ..... A63B 23/0405
2009/0124464 A1 * 5/2009 Kastelic ..... A63B 17/04 482/52
2010/0099541 A1 * 4/2010 Patel ..... A63B 21/00181 482/52
2014/0283728 A1 * 9/2014 Wang ..... B63G 11/00 114/261
2015/0066171 A1 * 3/2015 Brussog ..... H04L 67/125 700/91

* cited by examiner

*Primary Examiner* — Stephen R Crow
(74) *Attorney, Agent, or Firm* — Mark M. Friedman

(57) ABSTRACT

A system including a set of at least three horizontal tread surfaces, and a drive system for displacing the tread surfaces vertically to form a set of stairs with a range of different rise heights. One end of a ramp is hingedly connected to the last tread surface so as to define a walking surface having a variable angle of inclination varying as a function of a vertical position of the last tread surface. The tread surfaces can assume a fully-lowered state in which the set of tread surfaces are juxtaposed as a continuous flat surface, and in which a support configuration supports the second end of the ramp so that, in the fully-lowered state, the walking surface of the ramp is horizontal, so that the tread surfaces and the walking surface together forming a continuous horizontal walkway.

9 Claims, 9 Drawing Sheets

PHYSIOTHERAPEUTIC STAIR AND INCLINE SYSTEM

FIELD AND BACKGROUND OF THE INVENTION

The present invention relates to physiotherapy devices and, in particular, it concerns a physiotherapeutic system combining stairs and an incline, and in which treatment is preferably tracked and documented by use of a computer system associated with an integrated sensor set.

Many patients require physiological rehabilitation for various reasons. These include, for example, victims of traffic accidents, patients who have suffered from a cardiac episode or underwent a cardiac medical procedure, as well as individuals that have had a cerebral episode, invasive medical procedures, or sustained injuries of violence and the like. These patients need to receive physiotherapeutic treatment in rehabilitation wards of various institutions or by professional physiotherapists, for the purpose of a gradual return to regular life.

The practicing of walking, ascending and descending stairs is a central part of the rehabilitation process. The ability to ascend and descend stairs is a vital component in the assessment process performed by the medical staff when deciding whether a patient can be discharged from the rehabilitative institution to his or her home.

One example of a suitable device for practicing ascending and descending of stairs is described in U.S. Pat. No. 5,901,813, and is commercially available from DPE Medical Ltd. (Israel) under the name Dynamic Stair Trainer (DST). The device consists of number of stairs whose height can be altered simultaneously according to the need and ability of the current patient.

Stair trainers used in physiotherapy for ascending and descending stairs are preferably static during use with a uniform pitch, simulating the look and feel of conventional stairs. It is also preferable that adjustment of the height occurs through a purely vertical motion without changing the depth of the tread surface of each step, and that the steps have closed riser surfaces without overlap between steps to minimize risk of tripping.

A further development of DPE Medical Ltd. (Israel) is described in U.S. Pat. No. 9,381,397, which is hereby incorporated by reference as if set out herein in its entirety.

SUMMARY OF THE INVENTION

The present invention is a physiotherapeutic system combining stairs and an incline.

According to the teachings of an embodiment of the present invention there is provided, a system for deployment on an underlying surface, the system comprising: (a) a set of at least three horizontal tread surfaces including a first tread surface and a last tread surface; (b) a drive system mechanically linked to the set of tread surfaces and configured to displace at least two of the tread surfaces vertically so as to adjust a rise height between adjacent of the tread surfaces in such a manner as to form a set of stairs with uniform pitch for a range of different rise heights; and (c) a ramp having a first end hingedly connected to the last tread surface so as to define a walking surface from the first end to a second end of the ramp, the walking surface having a variable angle of inclination varying as a function of a vertical position of the last tread surface, wherein the drive system is configured to displace the tread surfaces to a fully-lowered state in which the set of tread surfaces are juxtaposed as a continuous flat surface, and further comprising a support configuration deployed to support the second end of the ramp over a range of motion such that, in the fully-lowered state, the second end of the ramp is supported above the underlying surface with the walking surface horizontal, the plurality of tread surfaces and the walking surface together forming a continuous horizontal walkway.

According to a further feature of an embodiment of the present invention, the drive system comprises a linear actuator deployed for raising the last tread surface vertically, the linear actuator being deployed outside an area of the walkway.

According to a further feature of an embodiment of the present invention, the continuous horizontal walkway is at a first height above the underlying surface, the system further comprising a connecting ramp having an upper edge hingedly connected to the second end of the ramp, the connecting ramp terminating at a lower edge adjacent to the underlying surface.

According to a further feature of an embodiment of the present invention, the drive system is configured to displace the tread surfaces so as to form the set of stairs with a plurality of rise heights substantially spanning a majority of a range from 0 cm to 18 cm.

According to a further feature of an embodiment of the present invention, the drive system is configured to displace the tread surfaces in a purely vertical motion, and wherein a plurality of the tread surfaces each has an associated vertical riser surface.

According to an additional, or alternative, feature of an embodiment of the present invention, there is also provided: (a) a set of sensors including: (i) a first sensor deployed to sense the presence of a patient on the first tread surface, (ii) a second sensor deployed to sense the presence of a subject on the last tread surface, and (iii) a third sensor deployed to sense the presence of a subject on the ramp in a region adjacent to the second end; and (b) a computer system comprising at least one processor and a non-volatile storage medium, the computer system being in communication with the set of sensors, the computer being configured to generate a data record of a patient activity, wherein the patient activity is determined at least in part from a sequence of outputs of the first, second and third sensors.

According to a further feature of an embodiment of the present invention, the set of sensors further comprises a rise height sensor deployed to generate an output indicative of a current rise height of the set of steps and a current inclination of the ramp, the computer being configured to perform at least two of the following: (a) on sensing of a patient at the first sensor followed by the second sensor at non-zero rise height, to identify a time from sensing of the first sensor to sensing of the second sensor as a time taken for ascending stairs at the currently sensed rise height; (b) on sensing of a patient at the third sensor followed by the second sensor at non-zero rise height, to identify a time from sensing of the third sensor to sensing of the second sensor as a time taken for ascending a slope at an inclination corresponding to the currently sensed rise height; and (c) on sensing of a zero rise height, identify a time from sensing of a patient at the first sensor to sensing of a patient at the third sensor, or the reverse, as a time taken to walk a predefined horizontal distance.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
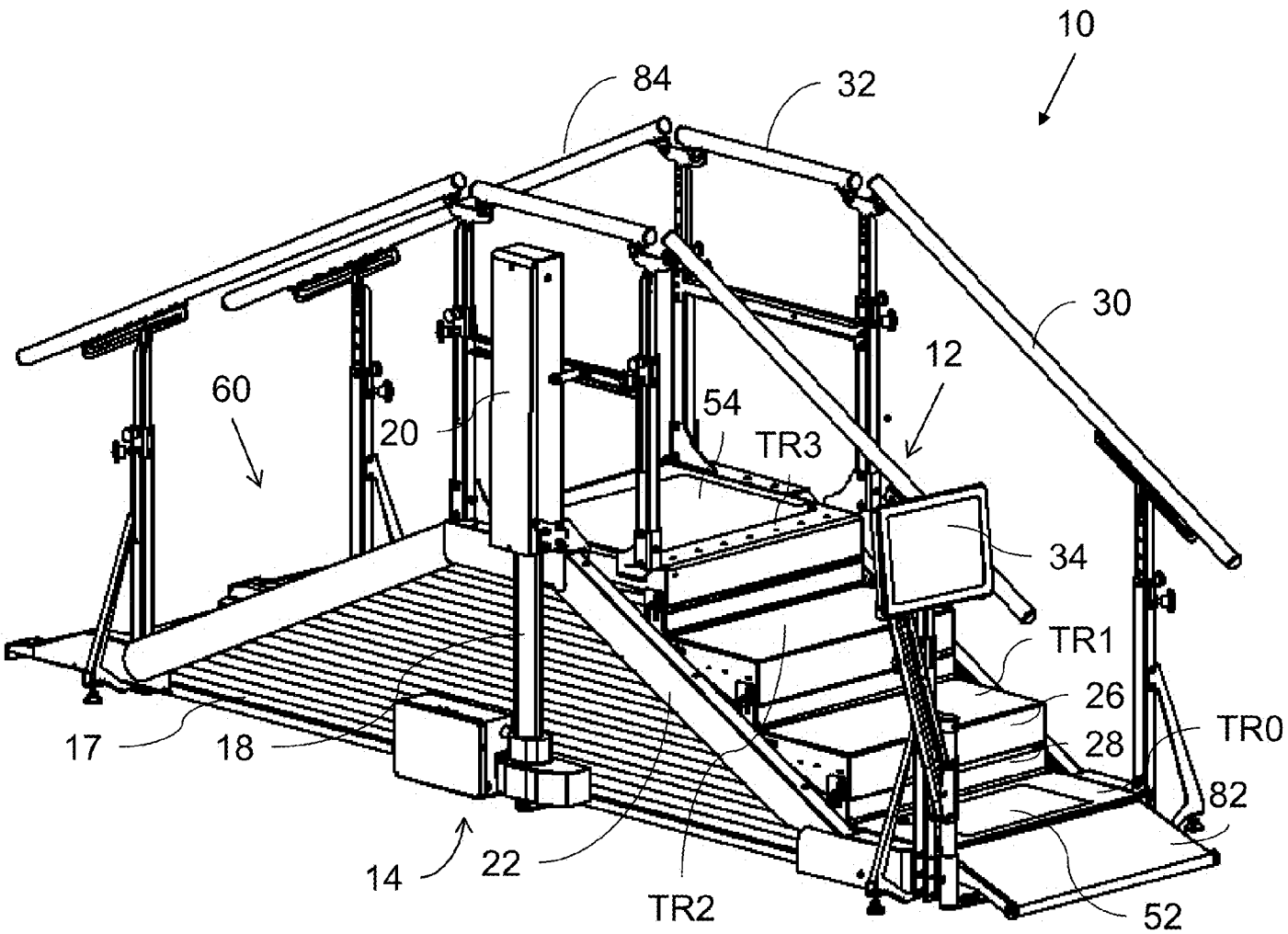
FIG. 1 is an isometric view of a therapeutic system, constructed and operative according to the teachings of an embodiment of the present invention, providing variable-rise steps and a variable-incline ramp, the system being shown in a fully-raised state.

The present invention is a physiotherapeutic system combining stairs and an incline, and corresponding methods for tracking and/or documenting therapy performed using the device.

The principles and operation of therapeutic systems according to the present invention may be better understood with reference to the drawings and the accompanying description.

Referring now to the drawings, FIGS. 1-7 show various full or partial views of a physiotherapeutic stair training system, generally designated 10, constructed and operative according to a particularly preferred embodiment of the present invention.

The structural basis of system 10 according to this particularly preferred example employs a stair structure and lifting mechanism generally similar to that of U.S. Pat. No. 9,381,397 to DPE Medical Ltd. (Israel). Thus, the device has a set 12 of at least three, and in the case shown here four, horizontal tread surfaces, individually referred to as TR0, TR1, TR2 and TR3. A drive system 14 is mechanically linked to the set 12 of tread surfaces and configured to displace at least two of the tread surfaces TR1-TR3 vertically so as to adjust a rise height between adjacent of the tread surfaces in such a manner as to form a set of stairs 12 with uniform pitch for a range of different rise heights.

Figure 4:
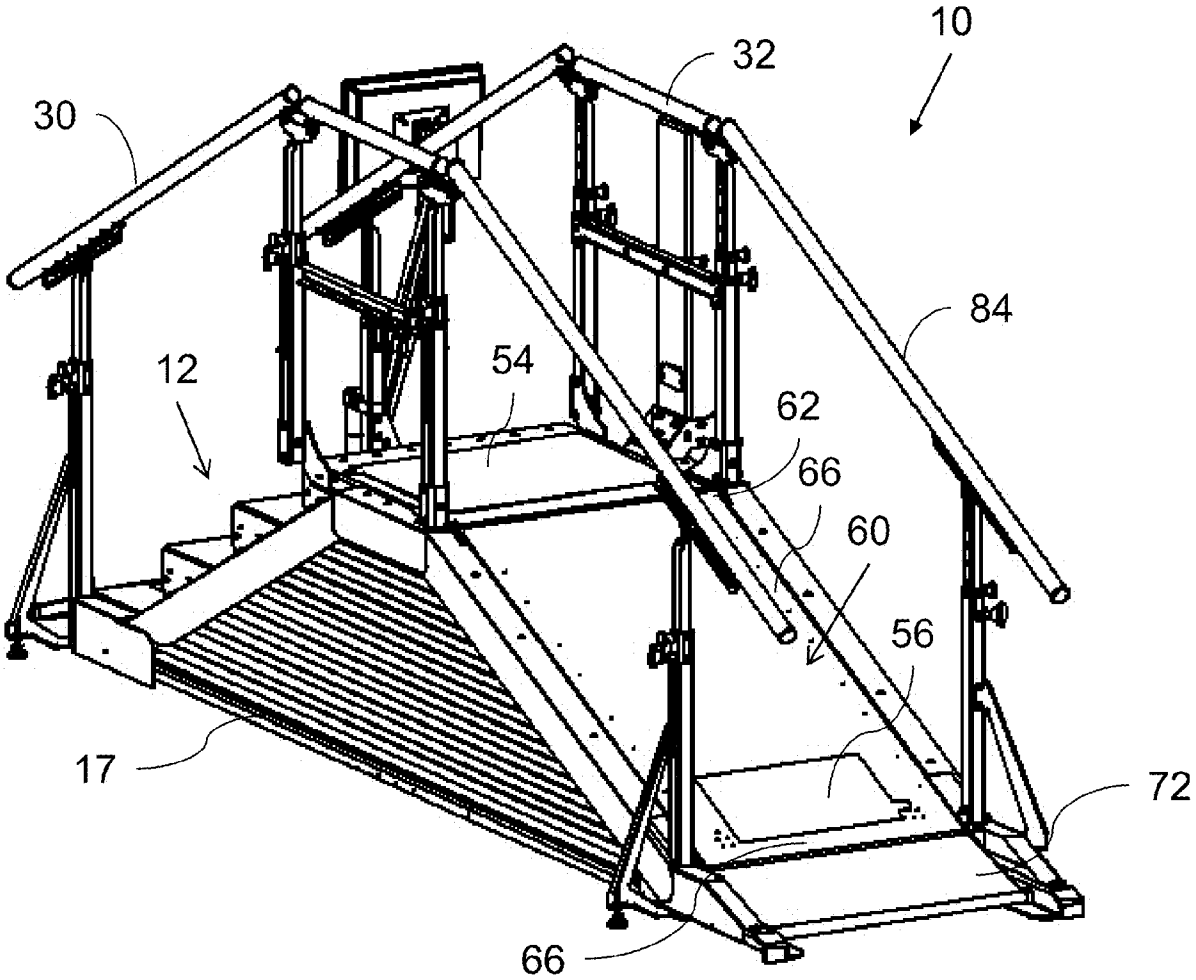
FIG. 4 is a view similar to FIG. 1 but taken from the ramp side of the system.
Figures 5A, 5B:
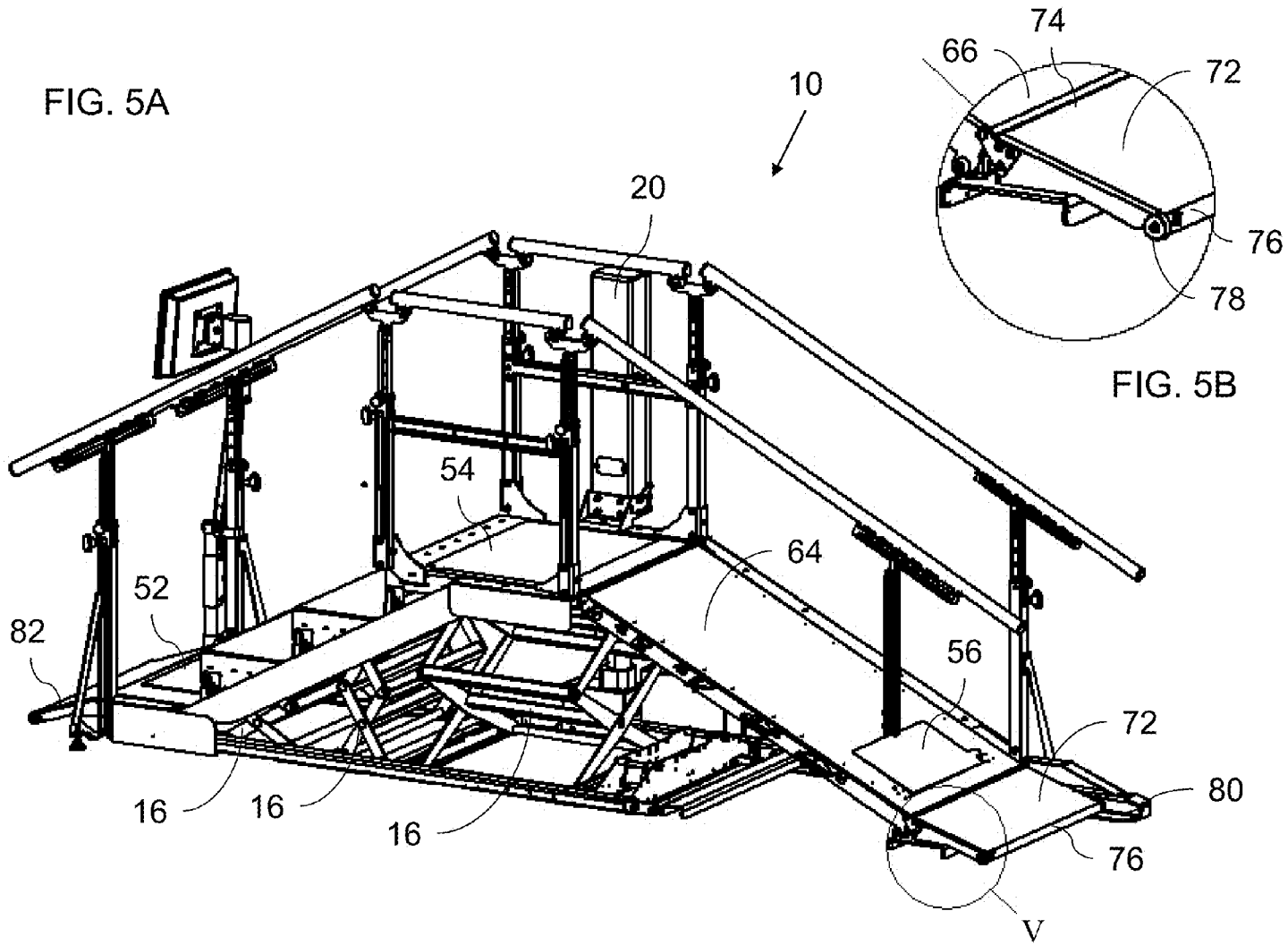
FIGS. 5A and 6A are views similar to FIG. 4 with selected elements removed to reveal internal components of the system.
FIGS. 5B and 6B are enlarged views of the regions of FIGS. 5A and 6A labeled V and VI, respectively.

A preferred hut implementation of drive system 14 is best seen in FIG. 5A. Under each tread surface is a scissors mechanism 16, which allows vertical movement of the tread surface while ensuring that it remains parallel to the floor. A linear drive, shown here in the form of a screw actuator 18, is deployed in a column 20 beside top tread surface TR3 and deployed to move tread surface TR3 vertically. Other types of actuators, such as hydraulic or pneumatic actuators, may also be used. Two side rails 22 are pivotally linked to top tread surface TR3 so as to be lifted at one end as the top tread surface rises. Each of the other tread surfaces has lateral projections 24 (FIG. 3) which engage rails 22 as a track, thereby lifting each tread surface in proportion to the elevation of the top surface and maintaining a set of stairs 12 of uniform pitch. In FIGS. 1 and 4, the scissors mechanisms are hidden by a folding protective skirt 17 to prevent objects or persons from being caught in the mechanisms, the protective skirt having been removed in FIGS. 5A and 6A to reveal the structural details.

It is important for stair therapy treatment that the steps are closed steps, i.e., with closed riser surfaces, so that the toes of a patient do not get caught beneath the step. To this end, each tread surface (other than TR0) is generally integrally formed with a riser surface 26 to form a step structure. Drive system 14 is preferably configured to displace the tread surfaces in a purely vertical motion, such as through the aforementioned scissors mechanisms 16.

Figure 2:
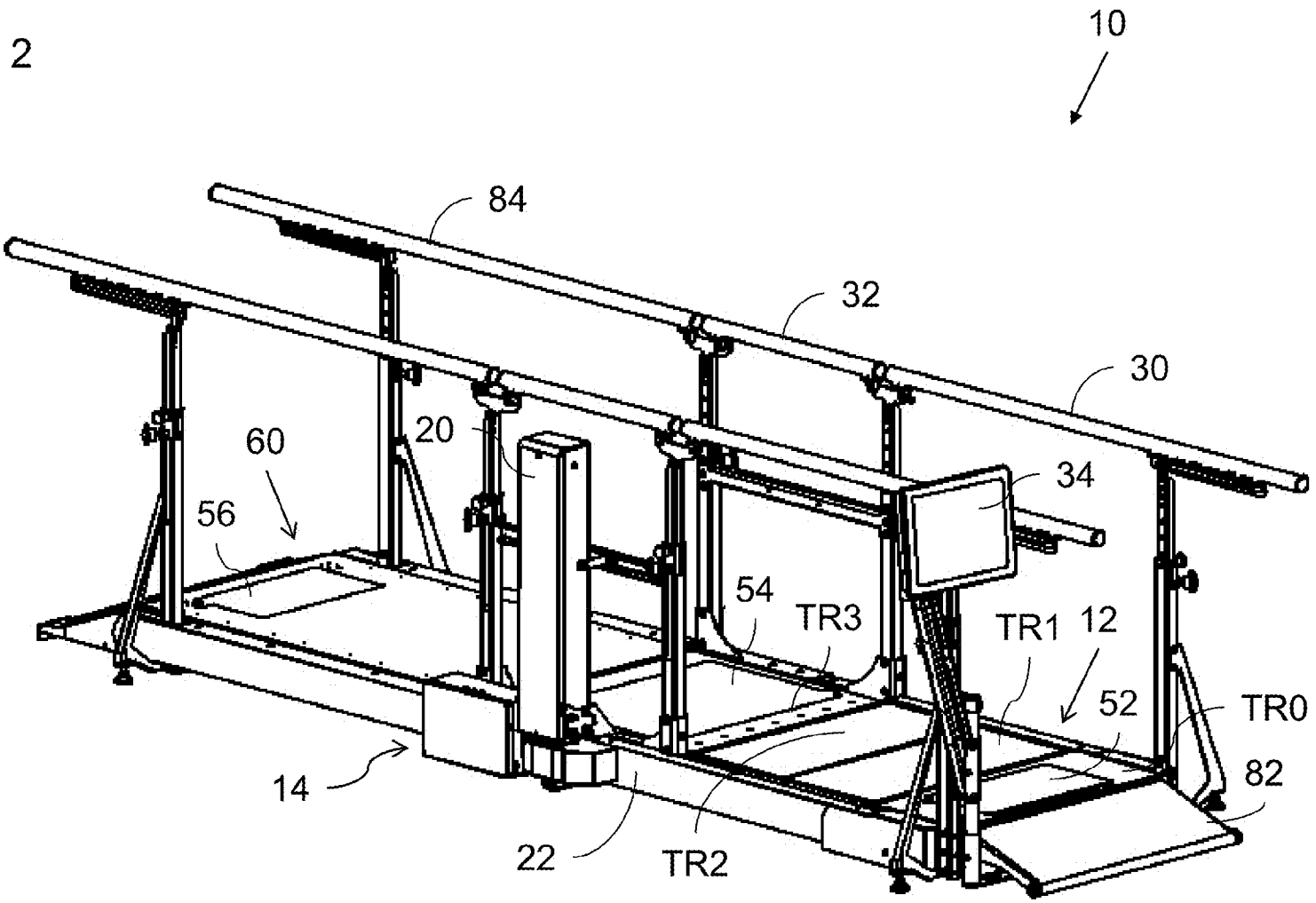
FIG. 2 is an isometric view of the therapeutic system of FIG. 1, the system being shown in a fully-lowered state.
Figure 3:
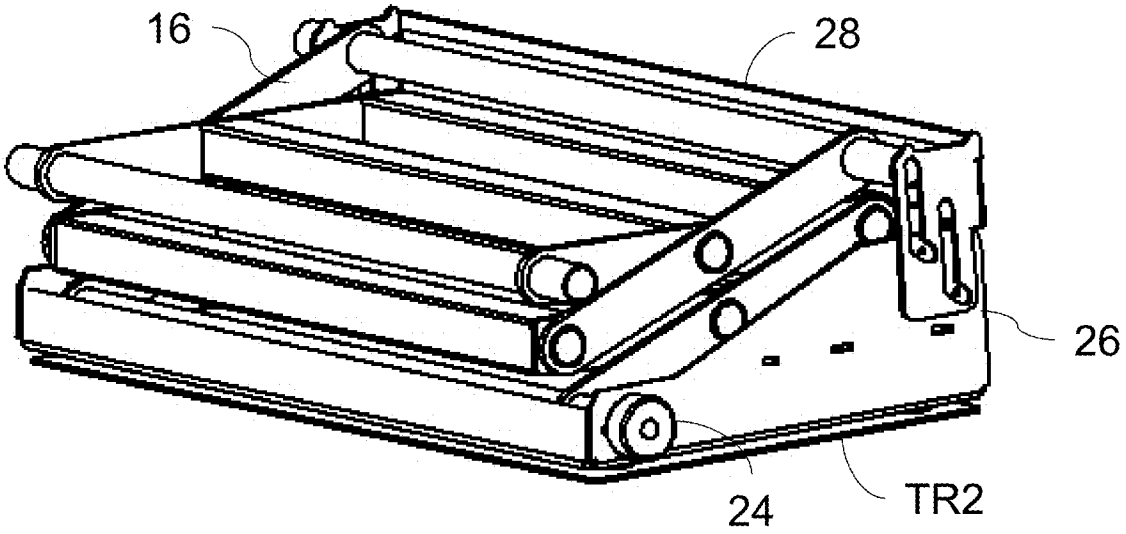
FIG. 3 is an isometric view of one of the steps from the system of FIG. 1 inverted to reveal an internal mechanism.

In the particularly preferred case illustrated in FIG. 3, each step also includes a telescopic extension portion 28 which provides an extension to riser surface 26 in the higher raised positions of the system, such as is seen in FIG. 1. The use of a telescopic extension portion allows the system to assume a fully lowered state (FIG. 2) in which a spacing from the floor is less than the maximum rise height of the set of stairs 12 in the fully raised state. By way of example, certain particularly preferred implementations of the present invention provide an adjustable step rise up to in excess of 16 centimeters, and preferably up to at least 18 centimeters, while the tread surfaces in the fully-lowered state are preferably less than 15 centimeters above the underlying surface, and most preferably no more than about 12 centimeters above the underlying surface.

The system preferably also includes at least one handrail extending alongside the set of stairs 12. In the implementation illustrated here, an adjustable-height handrail 30 is provided on each side of the set of stairs 12, and is complemented by handrail portions 32 extending along the top tread surface, which is here extended to form an upper platform to facilitate turning around between the ascent and descent when required. The handrail may additionally or alternatively be adjustable in horizontal position, to allow adjustment of the spacing between the right and left rails.

Drive system 14 is preferably configured to displace the tread surfaces so as to form the set of stairs 12 with a plurality of rise heights substantially spanning a majority of a range from 0 cm to 18 cm. "Substantially spanning" in this context refers to adjustability which provides either continuous adjustment or a plurality of discrete positions which are spaced apart by no more than 2 cm, and more typically in steps of 1 cm or less. In a particularly preferred implementation, the system provides adjustment to substantially span the entirety of a range of at least 0-18 cm, thereby facilitating practice of all common step sizes.

The system preferably assumes a fully flattened (zero step) state, as illustrated in FIG. 2. In this stage, the plurality of tread surfaces are juxtaposed as a continuous flat surface.

The present invention makes available an additional form of activity in the form of an adjustable ramp 60 (also referred to herein as a "slope" or "incline") for assessing and practicing the patient's ability to ascend and/or descend a slope. Ramp 60 has a first end 62 hingedly connected to the last tread surface TR3 so as to define a walking surface 64 from first end 62 to a second end 66 of the ramp. Walking surface 64 has a variable angle of inclination varying as a function of a vertical position of the last tread surface TR3.

It is a particular feature of certain preferred embodiments of the present invention that there is provided a support configuration deployed to support second end 66 of ramp 60 over a range of motion such that, in the fully-lowered state of FIG. 2, second end 66 of ramp 60 is supported above the underlying surface with its walking surface 64 horizontal so that the plurality of tread surfaces TR0, TR1, TR2, TR3 and walking surface 64 together form a continuous horizontal walkway. As described above, the various components such as scissor mechanisms 16 and riser surfaces 26 dictate a minimum height above the underlying surface at which the "zero" rise flat surface of the steps can be provided. If second end 66 of ramp 60 were to extend to the floor level, this would result in a small residual slope. The support configuration of this aspect of the present invention addresses this issue by ensuring that the orientation of walking surface 64 in the zero-rise state is parallel to the underlying surface, thus contributing to an extended horizontal walkway along the length of device 10, preferably of at least 2.5 meters, and typically at least about 3 meters long.

Figures 6A, 6B:
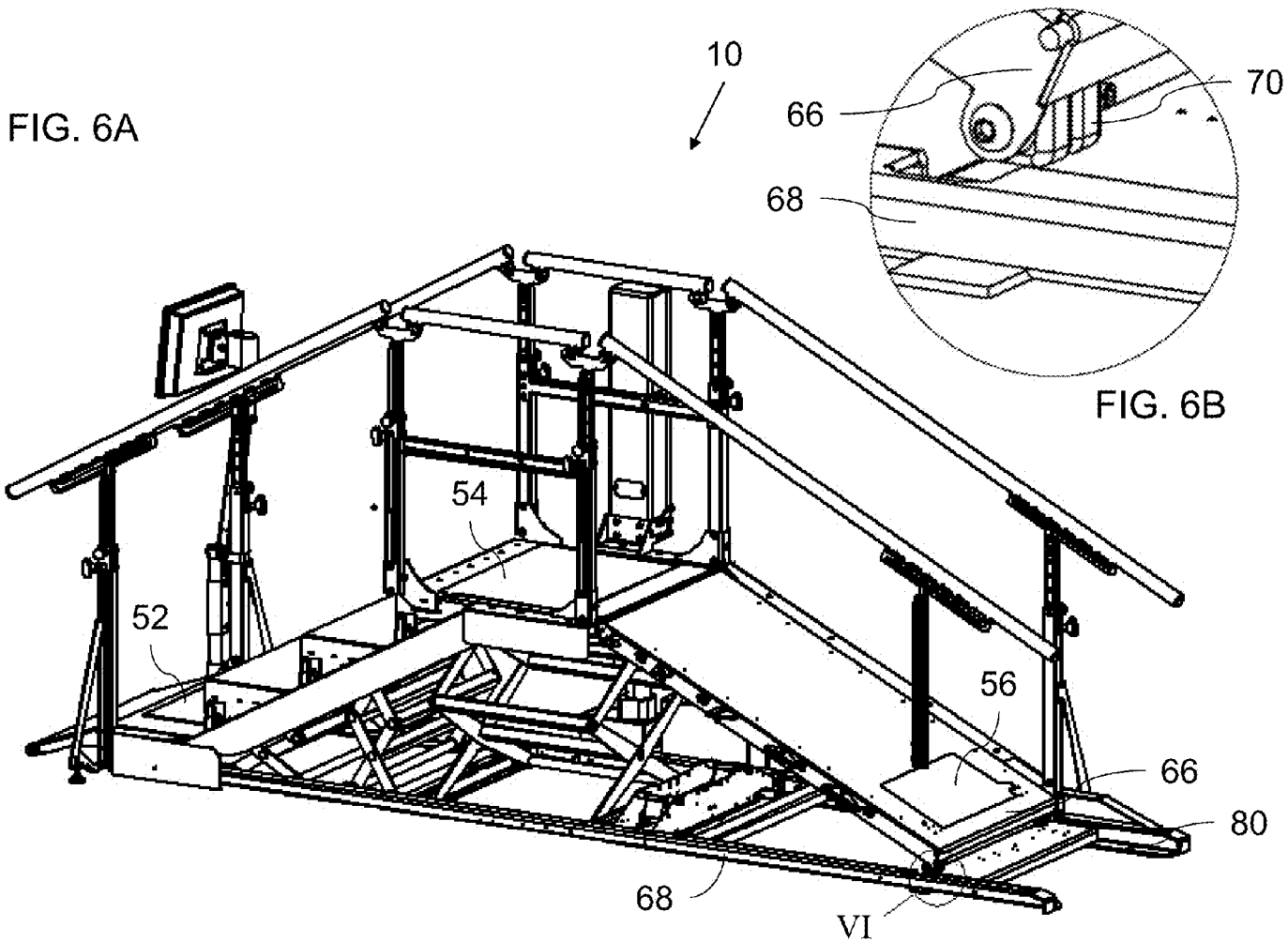

The support configuration may take a wide range of forms, and may define various different loci of motion of second end 66 as the angle of the ramp varies. In a particularly simple and effective implementation as best seen in FIGS. 6A and 6B, device 10 is formed with a pair of rails 68, which in the case illustrated here are elements of a device frame extending along the entire length of the device, along which second end 66 slides supported by sliding bearings 70. Sliding bearings may be preferred over rolling bearings due to the relatively large contact area and consequent spreading of load, although roller bearings may also be used.

In order to facilitate patients accessing ramp 60, a connecting ramp 72 is preferably provided with an upper edge 74 hingedly connected to second end 66 of ramp 60, as best seen in FIG. 5B. Connecting ramp 72 terminates at a lower edge 76 adjacent to the underlying surface. "Adjacent" in this context indicates that lower edge 76 is sufficiently close to the underlying surface that a patient's foot cannot get caught beneath it. Preferably lower edge 76 is also sufficiently thin that it does not present a significant step to mount the leading edge. The leading edge is therefore preferably no more than about 3 centimeters thick, and more preferably no more than about 2 centimeters thick. In order to minimize friction as the lower edge moves along the underlying surface during vertical motion of the first end 62 of ramp 60 and corresponding horizontal motion of second end 66, lower edge 76 of connecting ramp 72 is preferably also mounted on bearings, shown here as roller bearings 78, which may roll directly on the underlying surface or, more preferably, on a thin inward-projecting lip 80 from rails 68.

A second connecting ramp 82 it typically provided at the end of the device opposite to connecting ramp 72 to help patients mount the first step TR0. Step TR0 and connecting ramp 82 are typically fixed, static components.

In order to minimize the height of the device above the underlying surface when fully lowered, the linear actuator 18 deployed for raising the device vertically is preferably deployed outside the area of the walkway, as illustrated, and most typically adjacent to a side of the upper platform, corresponding to TR3.

An elevation sensor or "rise height sensor" 50 (FIG. 7, typically implemented as a linear encoder directly measuring the platform height, or a linear or rotary encoder tracking motion of the actuator) gives an indication of the position of the platform, and hence also of the step rise, at any time.

As a result of the structure described above, adjustment of the height of the central platform simultaneously adjusts both the uniform step height and the angle of inclination of the slope, making available two distinct modes of therapeutic activity. The output of the elevation sensor also indicates the current angle of inclination of the slope.

Figure 7:
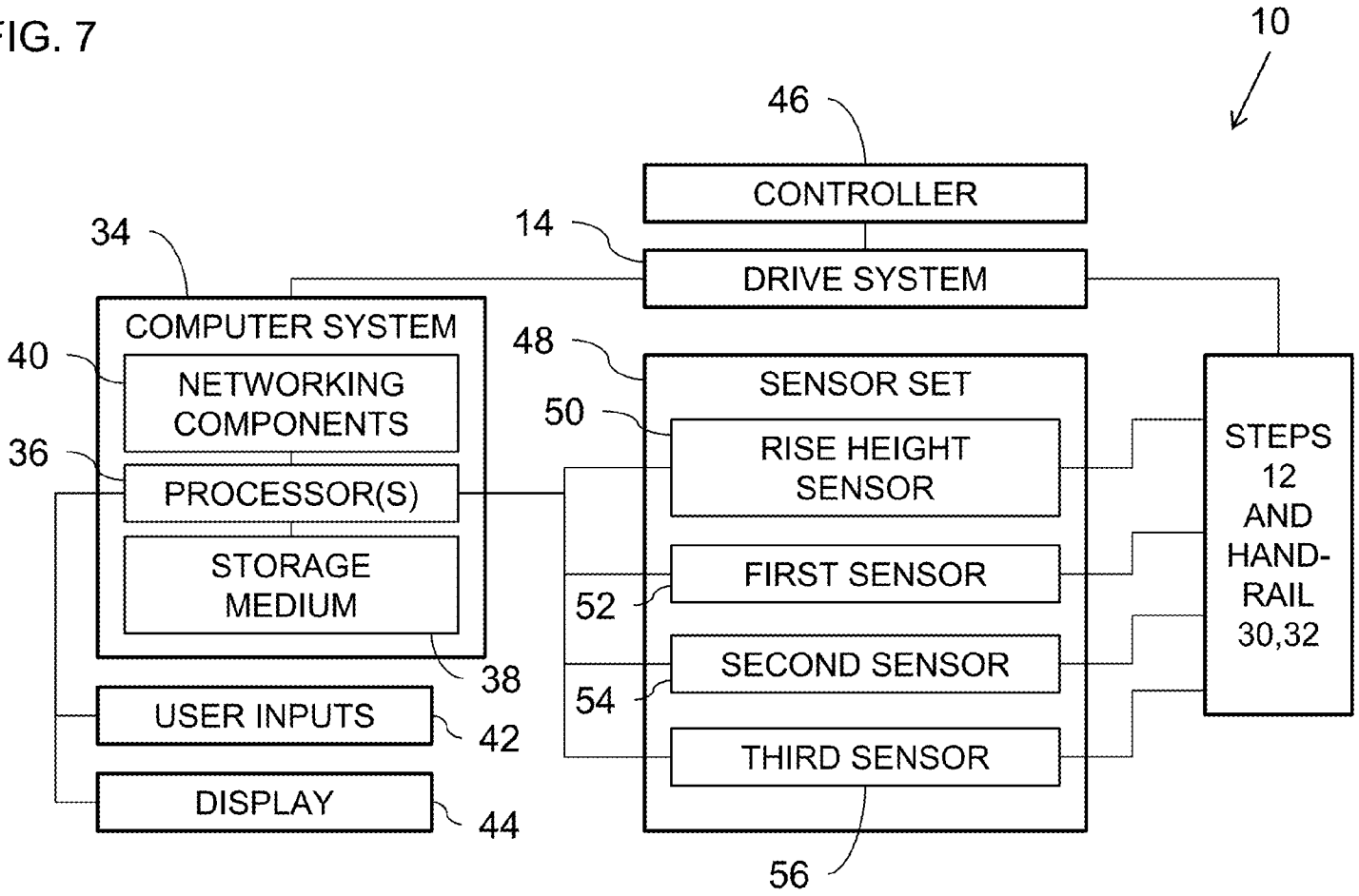
FIG. 7 is a block diagram of the system of FIG. 1.

In addition to the aforementioned components, as illustrated in the non-limiting example of FIG. 7, the present invention features a computer system 34 comprising at least one processor 36 and a non-volatile data storage medium 38, typically together with networking components 40 for connection to a wired or wireless network. Computer system 34 may be any type of suitable computer, including but not limited to, a general purpose computer running suitable software under a suitable operating system, and a dedicated computer system configured by suitable hardware, software and/or firmware to perform the various functions required. In some implementations, computer system 34 may be implemented using a mobile electronics device such as a smartphone operating suitable software and in wireless communication with the various other components of the system.

Computer system 34 is preferably associated with, and possibly integrated with, one or more user input device 42 and a display 44. In one preferred case, the entire computer system 34 is integrated in a "tablet" configuration with a touch-screen which serves as both the input device and the display, as illustrated schematically in FIG. 1.

Control of the up/down motion of drive system 14 may be achieved by pressing directly on up/down buttons on a controller 46 associated with drive system 14. Additionally, or alternatively, control of drive system 14 may be achieved via the user interface of computer system 34.

Computer system 34 is preferably associated with a sensor set 48 including at least one sensor deployed for measuring a parameter related to physiotherapy performed using device 10. Preferred examples of the sensors, and corresponding modes of operation of the system, are described below.

According to certain particularly preferred implementations of the present invention, the device is provided with at least three sensors for sensing the presence of the patient at specific locations on the device. These sensors preferably include a first sensor 52 deployed for sensing the presence of the patient on the first (lowest) step TR0; a second sensor 54 deployed for sensing the presence of the patient on the central platform TR3; and a third sensor 56 deployed for sensing the presence of the patient adjacent to the bottom end of the ramp 60. The sensors may advantageously be implemented as pressure sensors built into the surfaces on which the user steps, although any other suitable type of sensors may be used, including but not limited to: optical sensors, proximity sensors, RFID-based sensing arrangements, and image-processing-based detection.

Figure 8:
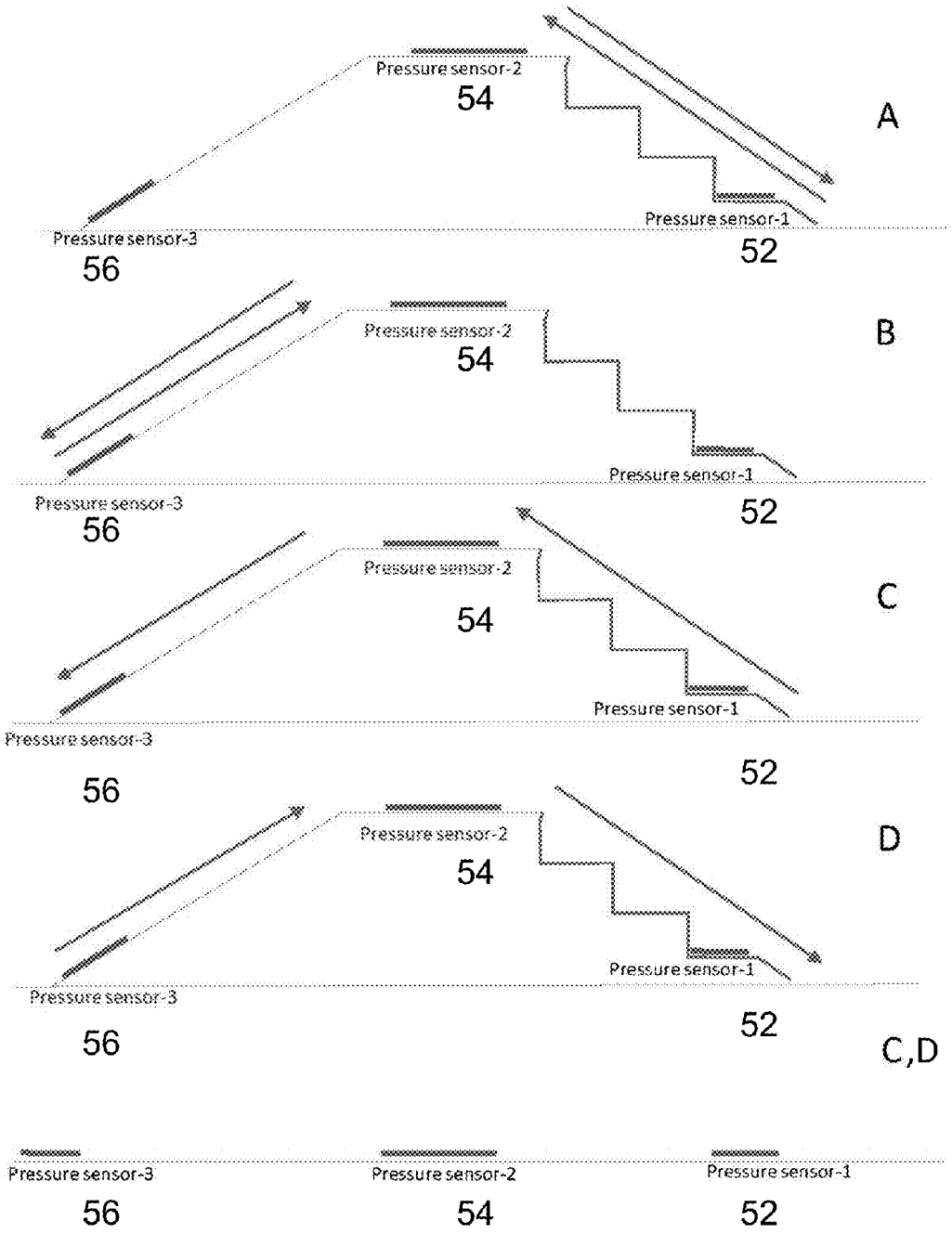
FIG. 8 is a schematic representation of various different modes of use of the system of FIG. 1.

The deployment of the first, second and third sensors 52, 54 and 56 as described herein provides valuable functionality, as the system can automatically identify and record the type(s) of activity performed during a treatment session. This is illustrated in FIG. 8. Specifically, the order in which the sensors detect the presence of the patient indicates what combination of stair or slope climbing or descent has been performed, as follows:

| Case | Order | Activity |
|---|---|---|
| A | 1-2-1 | Ascend stairs; descend stairs |
| B | 3-2-3 | Ascend slope; descend slope |
| C | 1-2-3 | Ascend stairs; descend slope |
| D | 3-2-1 | Ascend slope; descend stairs |
| C or D | 1-2-3 or 3-2-1 | [Zero elevation] Walking |

In addition to identifying the type of activity performed, the time from leaving one sensor until reaching the next gives a measure of the time taken on that occasion to complete the identified activity. This information is preferably stored together with the step rise or incline gradient/ angle as part of the patient's personal record of treatment and performance (using data storage and recall functionality provided by computer system 34 directly and/or via remote storage accessed via networking components 40), and can then be used to generate a graphic display and/or printed chart or graph of the patient's progress over a course of treatment, facilitating monitoring of the progress of treatment. By way of a non-limiting illustrative example, an on-screen display showing a patient's progress is illustrated in FIG. 9.

Figure 9:
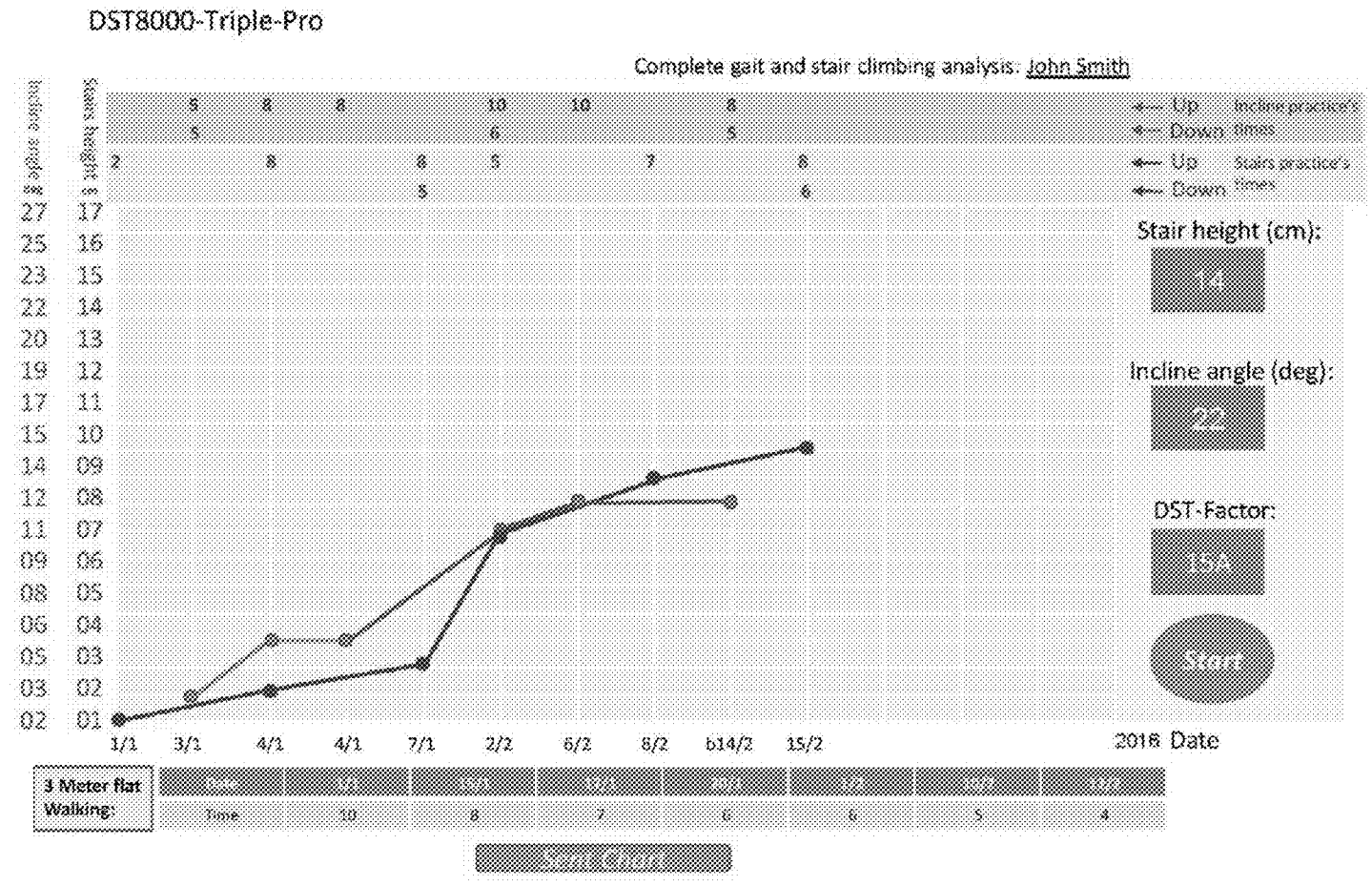
FIG. 9 is a schematic representation of a graphic user interface presenting data recorded by the system of FIG. 1 during a course of treatment for a give patient.

Parenthetically, it may be noted in FIG. 9 that the records of "UP" activities and "DOWN" activities in each therapy session do not necessarily balance. This occurs when a healthcare professional determines that the patient should focus on one or another activity, in which case the height of the device may be reduced or zeroed between ascending and descending, and the minor activity may not be recorded. Additionally, even where data exists for all activities of ascending/descending stairs/slope, it may be preferable to selectively display only part of the data in graphic form at any given time in order to avoid over-cluttering the display. Most preferably, a graphic user interface allows the healthcare professional to select the data to be displayed, for example, displaying plots of progress for ascending stairs and slope without descents, or displaying ascending and descending stairs only. Any and all other combinations may also be used.

Also included in the analytical data is a record of the level-surface walking time between sensors 1 and 3 (in either direction) which records the time taken for the patient to walk a predefined distance on a flat surface, in this case, about 3 meters. Walking ability is a further important indicator of the readiness of a patient to return to independent functioning outside a healthcare environment, and many treatment environments lack arrangements for accurately measuring and recording the level-surface walking ability of a patient. The combination step-and-incline device of the present invention thus provides significant added value by providing a tool for additionally monitoring and recording the level-surface walking ability of patients.

The device preferably includes handrails on both sides of the device, which are subdivided into rails 32 of the central platform, rails 30 for the stairs and rails 84 for ramp 60. The handrails preferably also extend to or beyond connecting ramps 72 and 82. The handrails for the stairs and ramp are preferably hingedly interconnected with supports for the central platform handrails, and are mounted via pin-in-slot engagements, or some other linear-bearing arrangement, to poles near the extremities of device 10, to accommodate changes in the length of handrail between the supports as the elevation is adjusted. The handrails are preferably supported by adjustable supports to allow for adjustment for patients of different heights, such as for adults and children. A mechanism may also be provided (not shown) to allow adjustment of the horizontal position of the handrails, and thus adjust the span between the handrails.

The system preferably includes or interfaces with additional components including, but not limited to, control system components, user interface components, networking components and remote computer systems, and/or additional sensors, to provide additional functionality. By way of non-limiting examples, the various sensors for weight distribution, heart rate etc. described in the aforementioned U.S. Pat. No. 9,381,397 may all be implemented to advantage in the context of the present invention.

It will be appreciated that the above descriptions are intended only to serve as examples, and that many other embodiments are possible within the scope of the present invention as defined in the appended claims.

What is claimed is:

1. A system for deployment on an underlying surface, the system comprising:

(a) a set of at least three horizontal tread surfaces including a first tread surface and a last tread surface;

(b) a drive system mechanically linked to said set of tread surfaces and configured to displace at least two of said tread surfaces vertically so as to adjust a rise height between adjacent of said tread surfaces in such a manner as to form a set of stairs with uniform pitch for a range of different rise heights; and (c) a ramp having a first end hingedly connected to said last tread surface so as to define a walking surface from said first end to a second end of said ramp, said walking surface having a variable angle of inclination varying as a function of a vertical position of said last tread surface, wherein said drive system is configured to displace said tread surfaces to a fully-lowered state in which said set of tread surfaces are juxtaposed as a continuous flat surface, and further comprising a support configuration deployed to support said second end of said ramp over a range of motion such that, in said fully-lowered state, said second end of said ramp is supported above the underlying surface with said walking surface horizontal, said plurality of tread surfaces and said walking surface together forming a continuous horizontal walkway.

2. The system of claim 1, wherein said drive system comprises a linear actuator deployed for raising said last tread surface vertically, said linear actuator being deployed outside an area of said walkway.

3. The system of claim 1, wherein said continuous horizontal walkway is at a first height above the underlying surface, the system further comprising a connecting ramp having an upper edge hingedly connected to said second end of said ramp, said connecting ramp terminating at a lower edge adjacent to the underlying surface.

4. The system of claim 1, wherein said drive system is configured to displace said tread surfaces so as to form said set of stairs with a plurality of rise heights substantially spanning a majority of a range from 0 cm to 18 cm.

5. The system of claim 1, wherein said drive system is configured to displace said tread surfaces in a purely vertical motion, and wherein a plurality of said tread surfaces each has an associated vertical riser surface.

6. The system of claim 1, further comprising:

(a) a set of sensors including:

(i) a first sensor deployed to sense the presence of a patient on said first tread surface, (ii) a second sensor deployed to sense the presence of a subject on said last tread surface, and (iii) a third sensor deployed to sense the presence of a subject on said ramp in a region adjacent to said second end; and (b) a computer system comprising at least one processor and a non-volatile storage medium, said computer system being in communication with said set of sensors, said computer being configured to generate a data record of a patient activity, wherein said patient activity is determined at least in part from a sequence of outputs of said first, second and third sensors.

7. The system of claim 6, wherein said set of sensors further comprises a rise height sensor deployed to generate an output indicative of a current rise height of said set of steps and a current inclination of said ramp, said computer being configured to perform at least two of the following:

(a) on sensing of a patient at said first sensor followed by said second sensor at non-zero rise height, to identify a time from sensing of said first sensor to sensing of said second sensor as a time taken for ascending stairs at the currently sensed rise height;

(b) on sensing of a patient at said third sensor followed by said second sensor at non-zero rise height, to identify a time from sensing of said third sensor to sensing of said second sensor as a time taken for ascending a slope at an inclination corresponding to the currently sensed rise height; and (c) on sensing of a zero rise height, identify a time from sensing of a patient at said first sensor to sensing of a patient at said third sensor, or the reverse, as a time taken to walk a predefined horizontal distance.

8. A system comprising:

(a) a set of at least three horizontal tread surfaces including a first tread surface and a last tread surface;

(b) a drive system mechanically linked to said set of tread surfaces and configured to displace at least two of said tread surfaces vertically so as to adjust a rise height between adjacent of said tread surfaces in such a manner as to form a set of stairs with uniform pitch for a range of different rise heights;

(c) a ramp having a first end hingedly connected to said last tread surface so as to define a walking surface from said first end to a second end of said ramp, said walking surface having a variable angle of inclination varying as a function of a vertical position of said last tread surface;

(d) a set of sensors including:

(i) a first sensor deployed to sense the presence of a patient on said first tread surface, (ii) a second sensor deployed to sense the presence of a subject on said last tread surface, and (iii) a third sensor deployed to sense the presence of a subject on said ramp in a region adjacent to said second end; and (e) a computer system comprising at least one processor and a non-volatile storage medium, said computer system being in communication with said set of sensors, said computer being configured to generate a data record of a patient activity, wherein said patient activity is determined at least in part from a sequence of outputs of said first, second and third sensors.

9. The system of claim 8, wherein said set of sensors further comprises a rise height sensor deployed to generate an output indicative of a current rise height of said set of steps and a current inclination of said ramp, said computer being configured to perform at least two of the following:

(a) on sensing of a patient at said first sensor followed by said second sensor at non-zero rise height, to identify a time from sensing of said first sensor to sensing of said second sensor as a time taken for ascending stairs at the currently sensed rise height;

(b) on sensing of a patient at said third sensor followed by said second sensor at non-zero rise height, to identify a time from sensing of said third sensor to sensing of said second sensor as a time taken for ascending a slope at an inclination corresponding to the currently sensed rise height; and (c) on sensing of a zero rise height, identify a time from sensing of a patient at said first sensor to sensing of a patient at said third sensor, or the reverse, as a time taken to walk a predefined horizontal distance.

* * * * *